United States Patent [19]

Otrhalek et al.

[11] 4,032,466

[45] June 28, 1977

[54] ACID CLEANER AND PROCESS FOR DISPOSAL THEREOF

[75] Inventors: Joseph V. Otrhalek, Dearborn; Gilbert S. Gomes, Southgate; Robert E. Gansser, Wyandotte, all of Mich.

[73] Assignee: BASF Wyandotte Corporation, Wyandotte, Mich.

[22] Filed: Apr. 16, 1976

[21] Appl. No.: 677,554

[52] U.S. Cl. ..... 252/136; 252/142; 134/3; 134/13; 134/40; 134/41

[51] Int. Cl.[2] ..... C23G 1/02; C23G 1/08; C23G 1/36

[58] Field of Search ..... 134/13, 3, 40, 41; 252/142, 136, 180, 181

[56] References Cited

UNITED STATES PATENTS

| | | | |
|---|---|---|---|
| 2,408,424 | 10/1946 | Healy et al. | 252/142 |
| 2,806,000 | 9/1957 | Streicher | 252/142 X |
| 3,100,727 | 8/1963 | Labergere | 134/13 |
| 3,173,875 | 3/1965 | Wegst et al. | 252/142 X |
| 3,443,991 | 5/1969 | Kremm | 134/3 |
| 3,575,711 | 4/1971 | Krofchak | 134/13 X |
| 3,738,868 | 6/1973 | Lancy | 134/13 |
| 3,793,221 | 2/1974 | Otrhalek et al. | 252/142 X |
| 3,832,234 | 8/1974 | Otrhalek et al. | 252/142 X |

*Primary Examiner*—Harris A. Pitlick
*Attorney, Agent, or Firm*—Robert J. Henry; Bernhard R. Swick; Robert E. Dunn

[57] ABSTRACT

A thickened acid cleaner concentrate composition comprising an inorganic acid, e.g., hydrochloric, an organic acid, e.g., oxalic, a nonionic surfactant, an anionic surfactant, a flocculating agent such as iron or aluminum ion and water is useful in cleaning vehicles such as railroad equipment. The waste water is then treated by flocculation and separation to remove suspended solids and entrained BOD prior to discharge or re-use within the plant. The flocculating agent in the composition provides a proportional pretreatment of the waste to facilitate the final treatment and separation of waste in the used composition.

8 Claims, No Drawings

ACID CLEANER AND PROCESS FOR DISPOSAL THEREOF

BACKGROUND OF THE INVENTION

1. Field of the Invention

The present invention relates to a thickened acid cleaner composition formed for facilitating subsequent treatment of the composition after use, and a method of treating the used cleaning composition to remove solids and entrained matter having a high biological oxidation demand.

2. Description of the Prior Art

Use of acid in cleaning compositions is known, for instance, U.S. Pat. No. 2,257,467 discloses a solidified acid composition for cleaning toilet bowls and the like wherein the composition consists of sodium silicate, water and hydrochloric acid. Another acid cleaner is disclosed in U.S. Pat. No. 3,271,319 wherein it is taught that stains can be removed from glass surfaces by the use of an acid cleaner consisting of water, hydrofluoric acid, a carboxymethylcellulose thickener and a small amount, usually less than 1 percent, of an alkyl sulfate or alkyl aryl sulfonate wetting agent. A still more recent patent, U.S. Pat. No. 3,622,391, teaches removing aluminide coatings from cobalt base or nickel base superalloys by the use of a hydrofluoric acid and water composition which permissably includes a low foaming or nonfoaming wetting agent.

Mineral acids have also been used in cleaning compositions as a defoamer. This technique is illustrated in U.S. Pat. No. 3,650,965 wherein the foaming qualities of nonionic surfactants for food industry cleaning can be reduced by the use of an organic acid coupled with a mineral acid such as phosphoric acid, the acid component being more than the surfactant component.

It has also been known to clean transportation equipment such as trains, boxcars and the like by the use of an acid cleaner to remove siliceous soils, followed by an alkaline cleaner to remove organic and oily soils, then finally followed by water rinsing. An especially good acid cleaner which is effective in cleaning vehicles such as railroad cars and locomotives is disclosed in U.S. Pat. No. 3,793,221.

It is well known that the use of cleaning compositions provides a waste water which may cause a disposal problem. This is particularly true when acid cleaners or the like are to be utilized. With the special emphasis now being made with respect to environmental protection, effective treatment of such wastes prior to disposal is positively essential.

In accordance with the usual procedures, waste treatment processes are adapted to remove suspended solids and reduce biological oxidation demand from the waste water prior to discharge or re-use of the water. In a typical operation, the waste water is treated with additives to assist in flocculation and subsequent filtration, sedimentation or floatation. However, a problem has been encountered in connection with the addition of flocculent, because accurate determination of the amount to be added varies with the washing process and needs to be measured when using the cleaner compositions of the prior art. In addition, heavy surges of waste water from batch type washing operations sometimes exceeds the capacity of the waste treatment facility.

SUMMARY OF THE INVENTION

In accordance with the invention, pretreatment of the waste water from the washing operation is effected by addition of a flocculating agent to the cleaning composition being used. In this way the amount of flocculent added is automatically and proportionally increased as the amount of cleaning solution is increased. However, it is important that the flocculent added to the cleaning solution does not reduce the efficiency of the cleaning activity, and it is considered advantageous to utilize an agent which does not form flocs in the cleaning solution prior to the washing operation. In addition, the flocculating agent must be stable in the strongly acid solution.

The best cleaning solutions now available include those described in U.S. Pat. No. 3,793,221 cited above, and the present invention is particularly applicable to improvements in such compositions. It has been found that not all flocculating agents can be added to such compositions, and achieve the desired results. However, flocculating agents which are active in the neutral and alkaline pH areas such as ions of aluminum or iron do not tend to form flocs in the acid cleaning solution, are stable, and are effective in providing pretreatment of the subsequent waste water in accordance with the invention. In such cases, the waste water is first made alkaline by combination with an alkaline wash, by adding an alkaline compound or both, and this effects pretreatment of the waste through the formation of aluminum hydroxide, ferrous hydroxide, or ferric hydroxide flocs. In this way, the final treatment of the waste water is simplified.

Thus it is seen that the invention also provides an improved acid cleaning composition, which has the advantage of easier disposal after use. In addition, the preferred acid cleaner composition is as good or better than the composition that does not contain aluminum or iron ions. This acid cleaner concentrate comprises:

1. an inorganic acid in an amount from about 5 to about 78 weight percent,
2. an organic acid selected from the group consisting of oxalic, tartaric, citric and mixtures thereof in an amount from about 1 to about 6 weight percent,
3. a nonionic surfactant in an amount from about 7 to about 23 weight percent,
4. an anionic surfactant in an amount from about 1 to about 7 weight percent,
5. a flocculating agent containing bivalent iron, trivalent iron or trivalent aluminum in soluble form in acid solution and in an amount of from about 1.0 to about 12.0 weight percent, and
6. water in an amount from about 75 to about 12 weight percent;

all weight percents being based on a total composition, provided that said nonionic surfactant and said anionic surfactant when taken together constitute from about 10 to about 30 weight percent of said composition and said nonionic surfactant constitutes from about 75 to about 90 weight percent of the combined weight of the nonionic and anionic surfactants.

The concentrate when diluted with 1 to 5 parts of water per part of concentrate is effectively used to remove siliceous and/or oily soils from metal vehicles without a subsequent alkaline rinsing by flowing on a continuous coat of the cleaner, allowing the cleaner to remain on the surface of the vehicle for a period of time followed by a simple rinsing with water under impingement force pressure.

However, alkaline rinsing may be used, if desired, and the rinse is then added to the waste wash water. Upon sufficient addition of alkaline material, usually by separate addition of sufficient alkaline compounds, flocculation occurs and treatment of the water begins. It is an important feature of the invention that the ratio of flocculent to cleaning composition is fixed by the inventive concept, and therefore some of the control systems heretofore required in the waste treating plant are not required.

DESCRIPTION OF THE PREFERRED EMBODIMENT

The inorganic acid employed in this invention is a strong acid such as hydrochloric, nitric, sulfuric and phosphoric. Preferably the acid is hydrochloric, which is of course an aqueous solution inasmuch as hydrogen chloride is a gas that is not suitable for convenient handling in laboratory and factory. In dealing with the term "hydrochloric acid or aqueous hydrochloric acid," it is meant commercially available concentrated hydrochloric acid which typically has an acid value of 36 to 37 percent by weight. Furthermore, it is within the scope of the preferred form of this invention to use as a partial replacement, that is, up to but no more than 50 percent by volume of hydrochloric acid, an equal volume amount of concentrated sulfuric acid, nitric, or phosphoric acid. For the purpose of this invention, sulfuric acid is considered to be the readily commercially available acid having a concentration of about 96 percent by weight. While phosphoric acid is readily available commercially in several acid strengths, it is convenient to use and handle 75 percent phosphoric acid, and for the purpose of this invention phosphoric acid will be understood to have a concentration of 75 percent by weight. Nitric acid is also available commercially in a plurality of strengths and any of these may be used. In view of the amounts of water which are also added to the cleaner concentrate of this invention, the hydrogen ion concentration variation between the foregoing mineral acids is not critical. However, it should be pointed out that the use of sulfuric acid and/or phosphoric acid as partial replacement for the hydrochloric acid of this invention is not favored for more than economic reasons. For instance, sulfuric acid introduces the formation of siliceous sulfate salts which are more difficult to remove in the washing process. Large volume usage of the cleaner concentrate of this invention containing phosphoric acid will result in accumulation of phosphate salts which are undesirable from an ecological balance viewpoint. Nitric acid is generally not preferred because of its cost. However, owing to the peculiarities of the soil to be removed and availability of acids at any given instance, small amounts of sulfuric acid, nitric acid and/or phosphoric acid can be used to replace part of the hydrochloric acid component of this invented composition. On a weight percent basis the acid cleaner of this invention will contain from about 5 to about 78 percent inorganic acid and, more preferably, this acid content will be from about 20 to about 30 weight percent.

The second component of the invented composition is an organic acid, preferably oxalic, tartaric, citric or mixtures thereof in an amount from about 1 to about 6 weight percent and, more preferably, in an amount from about 2 to about 4 weight percent. The organic acid suitable for use in this invention is characterized by an ability of chelating iron such that no more than about 3.5 parts of acid are required to chelate one part of iron. Furthermore, the organic acid or, should we say, chelating acid for iron must be soluble in the completed cleaner composition of this invention. It has been found that oxalic acid dihydrate, tartaric acid, and citric acid meet these requirements.

The particular surfactants employed in the invented composition in addition to having a cleaning effect also exhibit unusual thickening properties for this composition. Therefore, the surfactants of this invention are doubly critical. The nonionic surfactant is present in an amount from about 7 to about 23 weight percent of the final composition and, more preferably, in an amount from about 12 to 18 weight percent.

The nonionic surface active agents which are advantageously employed in the compositions of the invention are generally the polyoxyalkylene adducts of hydrophobic bases wherein the oxygen/carbon atom ratio in the oxyalkylene portion of the molecule is greater than 0.40. Those compositions which are condensed with hydrophobic bases to provide a polyoxyalkylene portion having an oxygen/carbon atom ratio greater than 0.40 include ethylene oxide, butadiene dioxide and glycidol, mixtures of these alkylene oxides with each other and with minor amounts of propylene oxide, butylene oxide, amylene oxide, styrene oxide, and other higher molecular weight alkylene oxides. Ethylene oxide, for example, is condensed with the hydrophobic base in an amount sufficient to impart water dispersibility or solubility and surface active properties to the molecule being prepared. The exact amount of ethylene oxide condensed with the hydrophobic base will depend upon the chemical characteristics of the base employed and is readily apparent to those of ordinary skill in the art relating to the synthesis of oxyalkylene surfactant condensates.

Typical hydrophobic bases which can be condensed with ethylene oxide in order to prepare nonionic surface active agents include mono- and polyalkyl phenols, polyoxypropylene condensed with a base having from about 1 to 6 carbon atoms and at least one reactive hydrogen atom, fatty acids, fatty amides and fatty alcohols. The hydrocarbons ethers such as the benzyl or lower alkyl ether of the polyoxyethylene surfactant condensates are also advantageously employed in the compositions of the invention.

Among the suitable nonionic surface active agents are the polyoxyethylene condensates of alkyl phenols having from about 6 to 20 carbon atoms in the alkyl portion and from about 5 to 30 ethenoxy groups in the polyoxyethylene radical. The alkyl substituent on the aromatic nucleus may be octyl, diamyl, n-dodecyl, polymerized propylene such as propylene tetramer and trimer, isooctyl, nonyl, etc. The benzyl ethers of the polyoxyethylene condensates of monoalkyl phenols impart good properties to the compositions of the invention and a typical product corresponds to the formula:

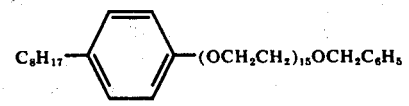

Higher polyalkyl oxyethylated phenols corresponding to the formula:

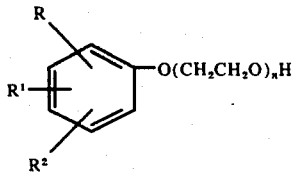

wherein R is hydrogen or an alkyl radical having from about 1 to 12 carbon atoms, $R^1$ and $R^2$ are alkyl radicals having from about 6 to 16 carbon atoms and *n* has a value from about 5 to 30 are also suitable as nonionic surface active agents. A typical oxyethylated polyalkyl phenol is dinonyl phenol condensed with 14 moles of ethylene oxide.

Other suitable nonionic surface active agents are cogeneric mixtures of conjugated polyoxyalkylene compounds containing in their structure at least one hydrophobic oxyalkylene chain in which the oxygen/carbon atom ratio does not exceed 0.40 and at least one hydrophilic oxyalkylene chain in which the oxygen/carbon atom ratio is greater than 0.40.

Polymers of oxylakylene groups obtained from propylene oxide, butylene oxide, amylene oxide, styrene oxide, mixtures of such oxyalkylene groups with each other and with minor amounts of polyoxyalkylene groups obtained from ethylene oxide, butadiene dioxide, and glycidol are illustrative of hydrophobic oxyalkylene chains having an oxygen/carbon atom ratio not exceeding 0.40. Polymers of oxyalkylene groups obtained from ethylene oxide, butadiene dioxide, glycidol, mixtures of such oxyalkylene groups with each other and with minor amounts of oxyalkylene groups obtained from propylene oxide, butylene oxide, amylene oxide and styrene oxide are illustrative of hydrophilic oxyalkylene chains having an oxygen/carbon atom ratio greater than 0.40.

Further suitable nonionic surface active agents are the polyoxyethylene esters of higher fatty acids having from about 8 to 22 carbon atoms in the acyl group and from about 5 to 30 ethenoxy units in the oxyethylene portion. Typical products are the polyoxyethylene adducts of tall oil, rosin acids, lauric, stearic and oleic acids and the like. Additional nonionic surface active agents are the polyoxyethylene condensates of higher fatty acid amines and amides having from about 8 to 22 carbon atoms in the fatty alkyl or acyl group and about 10 to 30 ethenoxy units in the oxyethylene portion. Illustrative products are coconut oil fatty acid amides condensed with about 5 to 30 moles of ethylene oxide.

Other suitable polyoxyalkylene nonionic surface active agents are the alkylene oxide adducts of higher aliphatic alcohols and thioalcohols having from about 8 to 22 carbon atoms in the aliphatic portion and about 5 to 30 oxyalkylene portion. Typical products are synthetic fatty alcohols, such as n-decyl, n-undecyl, n-dodecyl, n-tridecyl, n-tetradecyl, n-hexadecyl, n-octadecyl and mixtures thereof condensed with 5 to 30 moles of ethylene oxide, a mixture of normal fatty alcohols condensed with 8 to 20 moles of ethylene oxide and capped with benzyl halide or an alkyl halide, a mixture of normal fatty alcohols condensed with 5 to 30 moles of a mixture of ethylene and propylene oxides, a mixture of several fatty alcohols condensed sequentially with 2 to 20 moles of ethylene oxide and 3 to 10 moles of propylene oxide, in either order; or a mixture of normal fatty alcohols condensed with a mixture of propylene and ethylene oxides, in which the oxygen/carbon atom ration is less than 0.40, followed by a mixture of propylene and ethylene oxides in which the oxygen/carbon atom ratio is greater than 0.40 or a linear secondary alcohol condensed with 3 to 30 moles ethylene oxide, or a linear secondary alcohol condensed with a mixture of propylene and ethylene oxides, or a linear secondary alcohol condensed with a mixture of ethylene, propylene and higher alkylene oxides.

Of the foregoing described nonionic surface active agents or surfactants, a particularly preferred group is the polyethylene oxide condensates of alkyl phenols, particularly those having an alkyl group containing from about 6 to 12 carbon atoms in either a straight chain or branch chain configuration with ethylene oxide, the ethylene oxide being present in amounts equal to 5 to 25 moles of ethylene oxide per mole of alkyl phenol. This group of surfactants is exemplified by octylphenoxy polyethoxyethanol.

The second component of the surfactant system of this invented composition is an anionic surfactant which is present in an amount from about 1 to about 7 weight percent and, more preferably, in an amount from about 2 to about 3 percent.

Anionic synthetic non-soap detergents can be broadly described as organic sulfuric and sulfonic acid reaction products having in their molecular structure an alkyl radical containing from about 8 to about 22 carbon atoms and a radical selected from the group consisting of sulfonic acid and sulfuric acid ester radicals. (Included in the term "alkyl" is the alkyl portion of higher acyl radicals.) Important examples of the synthetic detergents which form a part of the preferred compositions of the present invention are those obtained by sulfating the higher alcohols ($C_8$–$C_{13}$ carbon atoms) produced by reducing the glycerides of tallow or coconut oil; alkyl benzene sulfonates, in which the alkyl group contains from about 9 to about 15 carbon atoms, including those of the types described in the U.S. Pat. Nos. 2,220,099 and 2,477,383 (the alkyl radical can be straight or branched aliphatic chain), alkyl glyceryl ether sulfonates, especially those ethers of the higher alcohols derived from tallow and coconut oil; coconut oil fatty acid monoglyceride sulfates and sulfonates; sulfuric acid esters of the reaction product of one mole of a higher fatty alcohol (e.g., tallow or coconut oil alcohols) and about 1 to 6 moles of ethylene oxide; sulfuric acid and sulfonic acid esters of the reaction product of one mole of a higher fatty oil (e.g., coconut or castor oil) and about 1 to 6 moles of ethylene oxide; alkyl phenolethylene oxide ether sulfate with about 1 to about 10 units of ethylene oxide per molecule and in which the alkyl radicals contain from 8 to about 12 carbon atoms; the reaction product of fatty acids esterfied with isethionic acid where, for example, the fatty acids are derived from coconut oil; fatty acid amide of a methyl tauride in which the fatty acids, for example, are derived from coconut oil; and others known in the art, a number being specifically set forth in U.S. Pat. Nos. 2,486,921; 2,486,922; and 2,396,278. While less preferred, the sodium and potassium salts of the foregoing sulfonic and sulfuric acid and/or ester anionic surfactants can also be used. The foregoing anionic surfactants are further exemplified in *McCutch-*

*eon's Detergents % Emulsifiers*, 1972 Annual, Allured Publishing Corporation, Ridgewood, New Jersey.

Particularly suited for the process and composition of this invention are the alkyl or aryl sulfonic acid anionic surfactants exemplified by a linear alkyl benzene sufonic acid.

When taken together in considering the foregoing nonionic and anionic surfactants, it is critical to the success of this cleaning composition that the total amount of surfactant present constitute from about 10 to about 30 weight percent of the total cleaner composition and that the nonionic portion of the total surfactant portion be from about 75 to about 95 weight percent.

The flocculating agent used in this invention is a soluble salt containing divalent iron, trivalent iron, trivalent aluminum or mixtures thereof, which is present in an amount of from about 1 to about 12 percent by weight (anhydrous weight) depending upon the particular salt used and the amount of water of hydration therein. In the preferred composition, the flocculating agent will be present in an amount of from about 3 to about 10 percent by weight based on the weight of anhydrous salt. Typical examples of salts that may be utilized are ferric sulfate, ferrous sulfate, ferric chloride, alum, aluminum chloride, sodium aluminate, ferric nitrate, aluminum nitrate, aluminum phosphate, aluminum oxalate, ferrous oxalate, or any of the acid salts of these materials. When the anion is oxalate, tartrate or citrate, the amount should be considered as contributing to the total organic acid in the mixture. In other words any soluble iron or aluminum salt may be used since the ions will be present in a strongly acid medium in the cleaning composition.

After use, the pH is increased and hydroxide flocs are formed in the waste water. Separation may then be effected either with or without further treatment. In this way, a problem heretofore present in waste treatment has been solved. At the same time, the cleaning composition of the invention is as good as similarly compounded cleaning composition without flocculating agent, and for some applications, it is better.

In certain cases, such as where unpainted metals are being washed, it is important to include a corrosion inhibitor in an amount sufficient to inhibit the action of the iron or aluminum ions in the cleaning compositions. In general, any of the well-known corrosion inhibitors are suitable for the purpose.

The final component of the invented cleaning composition is water which is present in an amount from about 75 to about 12 percent by weight and preferably in an amount from about 61 to about 32 weight percent.

In addition to the foregoing ingredients, as is well known in the detergent arts, to the cleaning composition can be added such things as dyes, perfumes and the like which do not detract from the present invention.

The foregoing acid thickened cleaner concentrates composition is diluted with water at the point of use to obtain the final cleaning composition. This dilution is preferably about 3 parts of water for each part of cleaner; however, dilution ratios of from about 1 part to about 9 parts of water per part of cleaner concentrate are satisfactory.

The compositions of this invention are prepared by standard, well-known open kettle mixing techniques known in the industry. A convenient charge schedule for preparation of the composition at room temperature would be to charge the water to the vessel, dissolve in the organic acid, followed by the nonionic surfactant, then the anionic surfactant, the hydrochloric acid and finally the flocculating agent. Should it be desired to add other optional modifiers to the composition such as inhibitors, dyes, and perfumes they can be added as convenient during the preparation of the composition.

The thickened acid cleaner concentrate after dilution is flowed onto the vehicle to be cleaned in an amount to obtain physical coverage of the vehicle so that a thin but continuous film is obtained. No brushing, scrubbing or other similar effort is required. The cleaner is allowed to remain at least 1 minute and preferably 5 minutes, however, up to 30 minutes is satisfactory when the vehicle is cleaned during cold weather. It is an advantage of the present composition that even if the water component of the composition evaporates during the period of application the cleaner can still be successfully rinsed afterwards. Rinsing is achieved by the use of water being sprayed on the vehicle with impingement force and is most conveniently achieved by simply passing the vehicle through the spray rinse. For locomotives a water delivery rate of 150 to 200 gallons per minute and at a pressure of 100 to 200 pounds per square inch is satisfactory. Preferably, the rinse will be applied at an angle starting at one end of the locomotive and sweeping forward to the other end and then reversing the angle and sweeping backward to the point of beginning. While the type of vehicle being washed will dictate the type of equipment being used, the acid cleaner composition of this invention is suitable for trucks and trailers, busses aiplanes, railroad engines, boxcars passenger cars, cabooses, off-road equipment and similar equipment.

The acid cleaner composition of this invention has the advantages of the composition of our U.S. Pat. No. 3,793,221 cited above. For instance, the previously used inert thickeners presented problems in removing the thickener residue after the washing, contributed to dry down problems and the simple disposal problem of the thickener residue after it was removed from the cleaned vehicle. Dry down of course refers to the drying of the cleaner film prior to its removal. It is recognized, of course, that the acid cleaner can be used with water of any hardness in contrast to alkaline cleaners which are dependent upon a certain degree of water softness in order to obtain desirable effects. In addition, the invention is particularly valuable in facilitating the removal of the organic and oily road soils from the used cleaning and rinse water. This is achieved by collecting the water in holding tanks or the like, together with additives which raise the pH and provide hydroxide flocs. Separation may then be effected by dissolved air floatation, gravity sedimentation or mechanical filtration without further treatment. However, it will be appreciated that further treatment may be provided, if desired, and that in such cases the further treatment is simplified by the use of the present invention.

The practice of this invention is illustrated by, but not limited by, the examples given below. Unless otherwise noted all parts or percents are parts or percents respectively by weight.

EXAMPLE 1

To an open kettle mixing vessel was charged 47.77 parts of water and then 3 parts of oxalic acid dihydrate was dissolved therein. Then 12 parts of alpha-alkyl ($C_{12}$–$C_{18}$) omega-hydroxy poly(oxyethylene) with the poly(oxyethylene) content averaging 9 moles, a nonionic surfactant of the ethoxylated monohydric alcohol type, was added. With continued mixing 4 parts of linear alkyl benzene sulfonic acid anionic surfactant of the alkane sulfonate type (Calsoft LAS-99 trademark) was blended in. 25.2 parts of 37 percent hydrochloric acid was added, followed by 5.4 parts of aluminum chloride hexahydrate. Finally, 2.00 parts of isopropyl alcohol, 0.13 part of propargyl alcohol and 0.50 part of dibutyl thiourea was added. The completed thickened acid cleaner was then discharged from the mixing vessel.

The cleaner had the following physical properties: viscosity at room temperature 80 centipoises and at 35° F. 120 centipoises; specific gravity at 75° F. is 1.0877 and density at 75° F. is 9.06 pounds per gallon; the pH of a 10 percent solution in distilled water is 0.60, precipitation point is 10° F.; freezing point is less than −40°; the cloud point of the concentrated solution is 170° F., at 1:1 dilution 103° F., at 1:2 dilution 97° F., at 1:3 dilution 99° F., and at 1:4 dilution 103° F. The viscosities of the thickened acid cleaners are excellent for the concentrate and dilutions through 1–3, and are good at a 1:3 dilution.

Flocculation tests were carried out by comparing the formulation of Example 1 with and without the aluminum chloride. 100 cc of water containing 1000 ppm dry soil in the form of ZORB-ALL Fines and 0.5 cc cleaning formula was combined and the pH adjusted to 6.5 with sodium bicarbonate. Then there was added 40 ppm of a flocculent which was a high molecular weight cationic polyacrylamide in a 25 percent (solids basis) emulsion. Various levels of alum were then added, and the flocculation results are given in Table I below.

Table I

| Alum Conc. | Cleaning Solution With Aluminum Chloride | Cleaning Solution Without Aluminum Chloride |
|---|---|---|
| 0 ppm | Good flocculation | No flocculation |
| 50 ppm | Good flocculation | Slight flocculation |
| 100 ppm | Good flocculation | Good flocculation |
| 150 ppm | Very good flocculation | Good flocculation |
| 200 ppm | Very good flocculation | Very good flocculation |

From the above Table, it is seen that good flocculation is obtained with the cleaning solution of the invention without addition of further flocculent.

EXAMPLE 2

To an open kettle mixing vessel was charged 51.64 parts of water, and 3.00 parts of oxalic acid dihydrate was dissolved therein. Then 10.5 parts of a nonionic surfactant of the ethoxylated monohydric alcohol was added. The nonionic surfactant was alpha-alkyl ($C_{12}$–$C_{18}$) omega-hydroxy poly(oxyethylene) with the poly(oxyethylene) content averaging 9 moles. With continued mixing 4.10 parts of linear alkyl benzene sulfonic acid anionic surfactant of the alkane sulfonate (Calsoft LAS-99 trademark) was blended in. 25.20 parts of 37% hydrochloric acid was added, followed by 3.40 parts of aluminum sulfate (powdered). Finally, 2.00 parts of isopropyl alcohol, 0.06 part of 2-mercaptobenzothiazole and 0.10 part of a flucculating agent (specifically a polyacrylamide, Nalco 625 trademark) was added. The completed thickened acid cleaner was then discharged from the mixing vessel.

The slightly turbid, light yellow cleaner thus formed had the following physical properties: specific gravity, 1.0824; density, 9.016 pounds per gallon; cloud point, 146°–148° F. (diluted 1:2, 106° F.); stable at 32° F., freezing point, −4° F., viscosity at 75° F., 176 centipoises; viscosity at 35° F., 510 centipoises; pH of solution diluted with 9 parts distilled water to 1 parts solution, 0.78. The solution was tested for flocculation ability as follows: 100 milliliters oily effluent was mixed with 0.5 milliliter of the solution of Example 2. Then 1.5 milliliters of sodium bicarbonate was added to raise the pH to between 7.0 and 7.5. The mixture flocculated satisfactorily.

EXAMPLE 3

To an open kettle mixing vessel was charged 42.94 parts water, and 3.00 parts of oxalic acid dihydrate was dissolved therein. Then 12.00 parts of a nonionic surfactant of the ethoxylated monohydric alcohol was added. The nonionic surfactant was alpha-alkyl ($C_{12}$–$C_{18}$) omega-hydroxy poly(oxyethylene) with the poly(oxyethylene) content averaging 9 moles. With continued mixing 4.00 parts of a linear alkyl sulfonic acid (Calsoft LAS-99 trademark) was blended in. 30.00 Parts of 37 percent hydrochloric acid was added, followed by 6.00 parts of ferric chloride hexahydrate. Finally, 2.00 parts of isopropyl alcohol and 0.06 part of 2-mercaptobenzothiazole were added. The completed thickened acid cleaner was then removed from the mixing vessel. This formulation was tested for flocculation performance utilizing the procedure of Example 2, and found to flocculate satisfactorily.

The foregoing concentrates are used by the following procedure: The concentrate is diluted with 3 volumes of water and stirred to obtain a uniform mixture. The diluted acid cleaner composition is then applied to a dirty locomotive by flowing on in contrast to the prior art teaching of misting on acid cleaners so that the locomotive has a very thin, continuous coating of acid cleaner. Approximately 3 gallons are applied to the locomotive. The cleaner is allowed to remain on the locomotive for approximately 5 minutes. The locomotive is then rinsed by driving the locomotive forward through a fixed spray at a speed of 5 to 8 miles an hour and then reversing the locomotive and bringing it back through the fixed sprays once more so that the water is applied at two different angles. The water pressure and delivery rate is 200 gallons of water per minute at 200 pounds per square inch. When dry, the locomotive is uniformly clean, free of residual siliceous road soils and oily road soils, has no streaks or spots left from the washing and the painted surface is unaffected by the wash treatment.

The effluent from the cleaning procedure is discharged to a waste treatment facility. There the pH is raised by the use of any of the conventional alkaline additives such as lime, soda ash, or causticsoda. When the pH reaches a value of about 7.0, the effluent starts forming flocs as a result of the flocculating agent contained in the cleaner. In this way, sufficient flocculating agent is added to handle surges without need for sophisticated controls. If desired, additional flocculating agents may also be added such as polyelectrolytes which could not be added directly in the desired amount to the cleaner. For example, a high molecular weight cationic polyacrylamide in a 25 percent (solids basis) emulsion provides good results. Although such additional flocculants may be added in the waste treatment plant, it will be appreciated that the method and cleaner of the invention providing a proportional pretreatment flocculant simplifies the controls at the final treatment plant and improves the overall flocculation and waste removal therewith.

The final removal may be carried out by any of the usual procedures such as separation by dissolved air floatation, gravity sedimentation or mechanical filtration. After separation, the treated water may be recycled or discharged to waste. Thus it is seen that this invention provides an improved acid cleaner and process for purification of the used cleaner, which is suitable for use in any of the conventional treatment facilities, and which provides a reliable and improved treatment procedure.

The foregoing examples and methods have been described in the foregoing specification for the purpose of illustration and not limitation. Many other modifications and ramifications will naturally suggest themselves to those skilled in the art based on this disclosure. These are intended to be comprehended as within the scope of this invention.

The embodiments of the invention in which an exclusive property or privilege is claimed are defined as follows:

1. A thickened acid cleaner concentrate composition consisting essentially of:

1. a strange aqueous inorganic acid in an amount from about 5 to about 78 weight percent,
2. an organic acid selected from the group consisting of oxalic, tartaric, citric acid and mixtures thereof in an amount from about 1 to about 6 weight percent,
3. a nonionic surfactant in an amount from about 7 to about 23 weight percent,
4. an anionic surfactant in an amount from about 1 to about 7 weight percent,
5. a flocculating agent containing bivalent iron, trivalent iron or trivalent aluminum in soluble form in acid solution and in an amount of from about 1 to about 12 weight percent, and
6. water in an amount from about 75 to about 12 weight percent;

all weight percents being based on the total composition, provided that the said nonionic surfactant and the said anionic surfactant when taken together constitute from about 10 to about 30 weight percent of said composition and said nonionic surfactant constitutes from about 75 to about 90 weight percent of the combined weight percent of nonionic and anionic surfactants.

2. The composition according to claim 1 wherein the aqueous inorganic acid contains at least 50 weight percent aqueous hydrochloric acid and the remaining acid is selected from the group consisting of hydrochloric acid, sulfuric acid, phosphoric acid and nitric acid.

3. The composition according to claim 2 wherein all the acid is aqueous hydrochloric acid.

4. The composition according to claim 1 wherein the organic acid is oxalic acid.

5. The composition according to claim 1 wherein the nonionic surfactant is an alkyl or alkylaryl polyether alcohol.

6. The composition according to claim 1 wherein the anionic surfactant is an alkyl or alkylaryl sulfonic acid.

7. The composition according to claim 1 wherein said aqueous inorganic acid is in an amount from about 20 to about 30 weight percent, said organic acid is in an amount from about 2 to about 4 weight percent, said nonionic surfactant is in an amount from about 12 to 18 weight percent, said anionic surfactant is in an amount from about 2 to about 6 percent, said flocculating agent is in an amount of about 3 to 10 percent, and said water is present in an amount from about 61 to about 32 weight percent.

8. The composition according to claim 7 wherein said aqueous inorganic acid is all aqueous hydrochloric acid, said organic acid is oxalic acid, said nonionic surfactant is an alkylaryl polyether alcohol and said anionic surfactant is an alkyl sulfonic acid containing from 8 to 20 carbon atoms.

* * * * *

UNITED STATES PATENT AND TRADEMARK OFFICE

CERTIFICATE OF CORRECTION

PATENT NO. : 4,032,466

DATED : June 28, 1977

INVENTOR(S) : Joseph V. Otrhalek, Gilbert S. Gomes and Robert E. Gansser

It is certified that error appears in the above-identified patent and that said Letters Patent are hereby corrected as shown below:

Column 8, line 32, after the word "busses", insert comma ---,---, and the word "aiplanes" should read ---airplanes---.

Column 8, line 33, after the word "boxcars", insert comma ---,---.

Column 11, claim 1, line 28, the word "strange" should read ---strong---.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,032,466 Dated June 28, 1977

Inventor(s) Joseph V. Otrhalek et al.

It is certified that error appears in the above-identified patent and that said Letters Patent are hereby corrected as shown below:

Column 8, line 32, after the word "busses" insert -- , --.
same line, "aiplanes" should read -- airplanes --.
Column 8, line 33, after the word "boxcars", insert -- , --.

Column 11, claim 1, line 28, the word "strange" should read -- strong --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*